United States Patent [19]

Platt

[11] 3,987,651

[45] Oct. 26, 1976

[54] COMBINED OSCILLATING AND UNIDIRECTIONAL AGITATOR FOR AUTOMATIC WASHER

[75] Inventor: Clark I. Platt, Benton Harbor, Mich.

[73] Assignee: Whirlpool Corporation, Benton Harbor, Mich.

[22] Filed: July 14, 1975

[21] Appl. No.: 595,792

Related U.S. Application Data

[63] Continuation of Ser. No. 418,378, Nov. 23, 1973, abandoned.

[52] U.S. Cl. ..... 68/133; 68/134; 74/126; 259/101

[51] Int. Cl.[2] ..... D06F 13/06

[58] Field of Search ..... 68/131–134, 68/28, 38, 53, 54, 89, 184, 23.6, 23.7; 259/101; 74/126; 192/46; 416/124, 169, 172

[56] References Cited

UNITED STATES PATENTS

| | | | |
|---|---|---|---|
| 1,704,932 | 3/1929 | Altorfer | 68/133 |
| 1,834,936 | 12/1931 | Bryant | 68/133 |
| 2,021,097 | 11/1935 | Maus | 68/133 |
| 2,253,989 | 8/1941 | Skinner | 68/54 X |
| 2,303,979 | 12/1942 | Blake | 68/23.7 X |
| 2,331,897 | 10/1943 | Dyer | 68/23.7 X |
| 2,502,702 | 4/1950 | Castner | 68/134 |
| 2,734,367 | 2/1956 | Geldhof | 68/133 |
| 3,112,632 | 12/1963 | Walton | 68/54 |
| 3,117,434 | 1/1964 | Byrd et al. | 68/134 |
| 3,678,714 | 7/1972 | Krolzick | 68/131 |
| 3,783,652 | 1/1974 | Archbold | 68/23.7 |
| D196,194 | 9/1963 | Krolzick | D49/1 |

*Primary Examiner*—Philip R. Coe
*Attorney, Agent, or Firm*—Hill, Gross, Simpson, Van Santen, Steadman, Chiara & Simpson

[57] ABSTRACT

Improved agitation means for use in a clothes washing machine of the type in which an agitator is oscillated by means of a drive mechanism to secure agitation of the clothes. The present invention provides a first agitator element and a second agitator element driven from a common driving source, the second agitator element being provided with means to urge clothes into a rollover pattern established by the coaction of the agitator elements and thereby impart a highly efficient rollover motion to the clothes.

32 Claims, 4 Drawing Figures

COMBINED OSCILLATING AND UNIDIRECTIONAL AGITATOR FOR AUTOMATIC WASHER

This is a continuation, of application Ser. No. 418,378, filed Nov. 23, 1973, and now abandoned.

BACKGROUND OF THE INVENTION

1. Field of the Invention

This invention is in the field of automatic washing machines employing vertical axis agitators which oscillate to provide a tumbling motion to the clothes contained within the machine and provides an agitator construction which is particularly useful with large or heavy clothes loads to improve the movement of the clothes within the machine and thereby the washing action.

2. DESCRIPTION OF THE PRIOR ART

It has long been appreciated that the most efficient clothes movement pattern for washing clothes within an automatic washing machine having a vertical axis agitator is a pattern which provides a rollover of the clothes which involves moving the clothes down the agitator barrel, then radially outward from the oscillating agitator vanes, upward along the wall of the tub, and inward to the barrel. Conventional washing machines are reasonably proficient in achieving this type of rollover pattern when light loads are being washed, but not with heavy loads. When the washing basket is tightly packed with clothes, the load crowds the agitator and the basket area. A conventional oscillating agitator has difficulty in attaining any kind of a rollover to the clothes load under these conditions. The conventional-type agitator then scrubs merely the bottom portion of a tightly-packed heavy load, resulting in a very poor uneven cleaning action.

There are a few examples in prior patents of agitators which move in separate paths during a washing operation. For example, the Bryant U.S. Pat. No. 1,834,936 suggests dual agitator members which are reciprocated in opposite directions within the tub, the object being to create a violent water action.

The Krolzic U.S. Pat. No. 3,678,714 assigned to the same assignee as the present invention describes a washing machine assembly including a pair of agitators, the two agitators being coupled together for mutual oscillation, but having cam means or the like provided between the two agitators to effect a vertical reciprocation of one with respect to the other during such oscillation.

Prior art patents disclose agitators with spiral vane elements. For example, Dyer U.S. Pat. No. 2,331,897 discloses a washing machine having an agitator provided with a spiral vane on an upper portion, the agitator rotating at motor speed during washing.

Krolzick U.S. Pat. Des. 196,194 assigned to the same assignee as the present invention shows an agitator for a laundry machine wherein the ornamental design for the agitator includes a spiral vane arrangement.

Geldhof U.S. Pat. No. 2,734,367, assigned to a predecessor of the assignee of the present invention, shows an agitator for a laundry machine wherein the agitator includes spiral vanes which extend in the form of radial vanes on their lower edges with radial projections or vanes extending intermediate the spiral vanes.

SUMMARY OF THE INVENTION

The present invention provides an improved agitator means and clothes washing method for use with an automatic washer having a clothes washing receptacle and drive means for driving an agitator in an oscillatory fashion. The improved agitator means of the present invention is a double action agitator and includes a lower agitator element which is engageable with the drive means for oscillation about an axis in the usual manner and an upper agitator element which is coaxial with the lower element and is coupled to the drive shaft by means of a one-way clutch. The upper agitator element is provided with auger-like vane means for urging clothes within the receptacle downwardly toward the lower agitator element where they are contacted by a set of generally vertically-extending vanes disposed about the skirt portion of the lower agitator element. In effect, therefore, the upper agitator element acts to continuously feed clothes downwardly along the barrel of the agitator where they come under the influence of the oscillating vertically positioned vanes of the lower agitator element which direct the clothes radially outwardly toward the periphery of the basket, and eventually upwardly and back to the barrel of the upper agitator element, completing a repeating rollover cycle which is extremely efficient for securing a uniform scrubbing contact of the clothes with the wash liquid.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
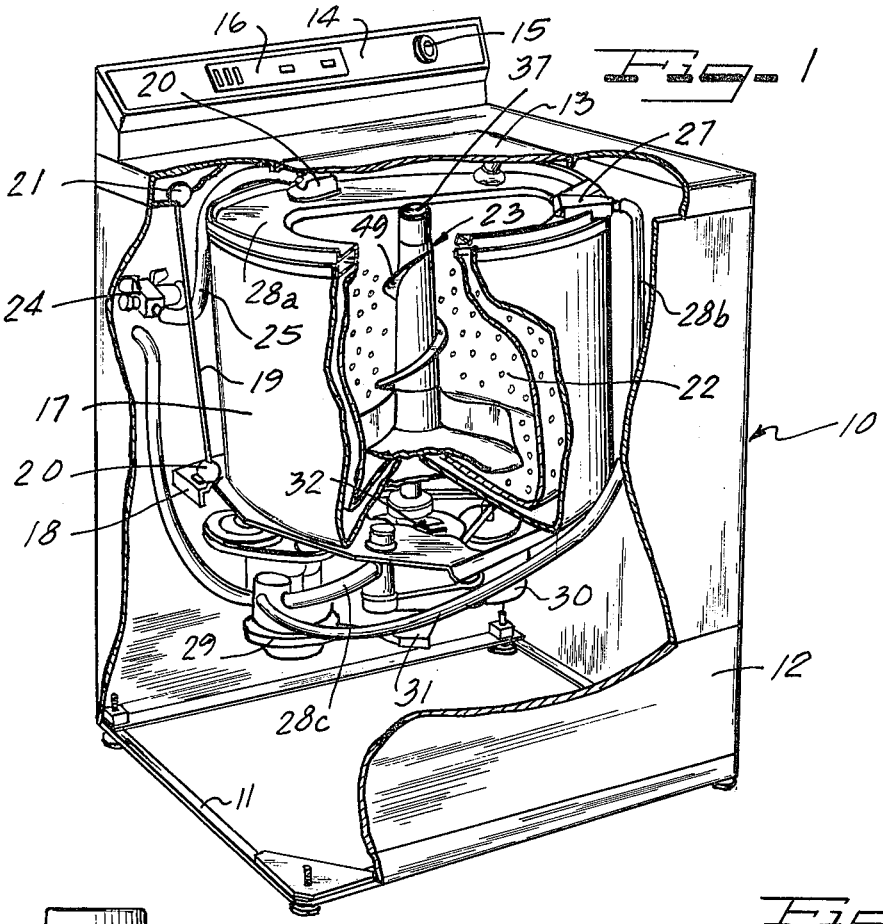
FIG. 1 is a view partly broken away, of a conventional automatic washing machine assembly provided with an improved agitator means according to the present invention.

In FIG. 1, reference numeral 10 indicates generally a washing machine of the automatic type including a frame 11 carrying vertical panels 12 forming the sides, front and back of the machine. A hinged lid 13 is provided in the usual manner to provide access to the interior of the washing machine. The washing machine 10 has the usual console 14 including a timer dial 15 and a program selector 16.

Internally of the machine there is disclosed an imperforate tub 17 which is supported within the cabinet by means of a base support plate 18. A plurality of suspension rods 19 having resilient spherical end portions 20 and 21 are positioned about the tub 17 in the usual manner to suspend the tub freely within the interior of the cabinet.

A perforate washing receptacle or basket 22 is positioned concentrically with the tub 17. Centrally of the perforate washing basket 22 is an improved agitator means which has been designated generally in the drawings at reference numeral 23.

Liquid is introduced into the washing machine by means of a solenoid controlled inlet valve 24 which directs the liquid through a conduit 25 and through an anti-siphon device 26 into the washing area. A filter 27 is positioned along a tub ring **28*a* disposed between the tub 17 and the basket 22. A conduit 28*b* connects the outlet port of a pump 29 to the filter 27, and a second conduit 28*c* provides fluid communication between the inlet port of pump 29 and the clothes washing area of the washing machine. During the agitate portion of the wash cycle wash water is circulated by the pump 29 through conduit 28*b* to filter 27, from the filter into the washing area, and from the washing area through a second conduit 28*c*** back to the pump. A filtering of the wash water is thus accomplished.

The pump as well as the other movable parts of the assembly are driven by means of a motor 30 which operates through a transmission 31. A clutch and brake assembly generally indicated at reference numeral 32 is provided for energizing the agitator means 23 during washing, and for disengaging the agitator and engaging a spin tube, subsequent to be described, for spinning the basket 22 during the liquid extracting portion of the washing phase. All of the drive elements and hydraulic units described thus far are conventional in vertical-axis automatic washing machines, and the improvements of the present invention are centered in the agitator means 23, which is described specifically below.

Figure 2:
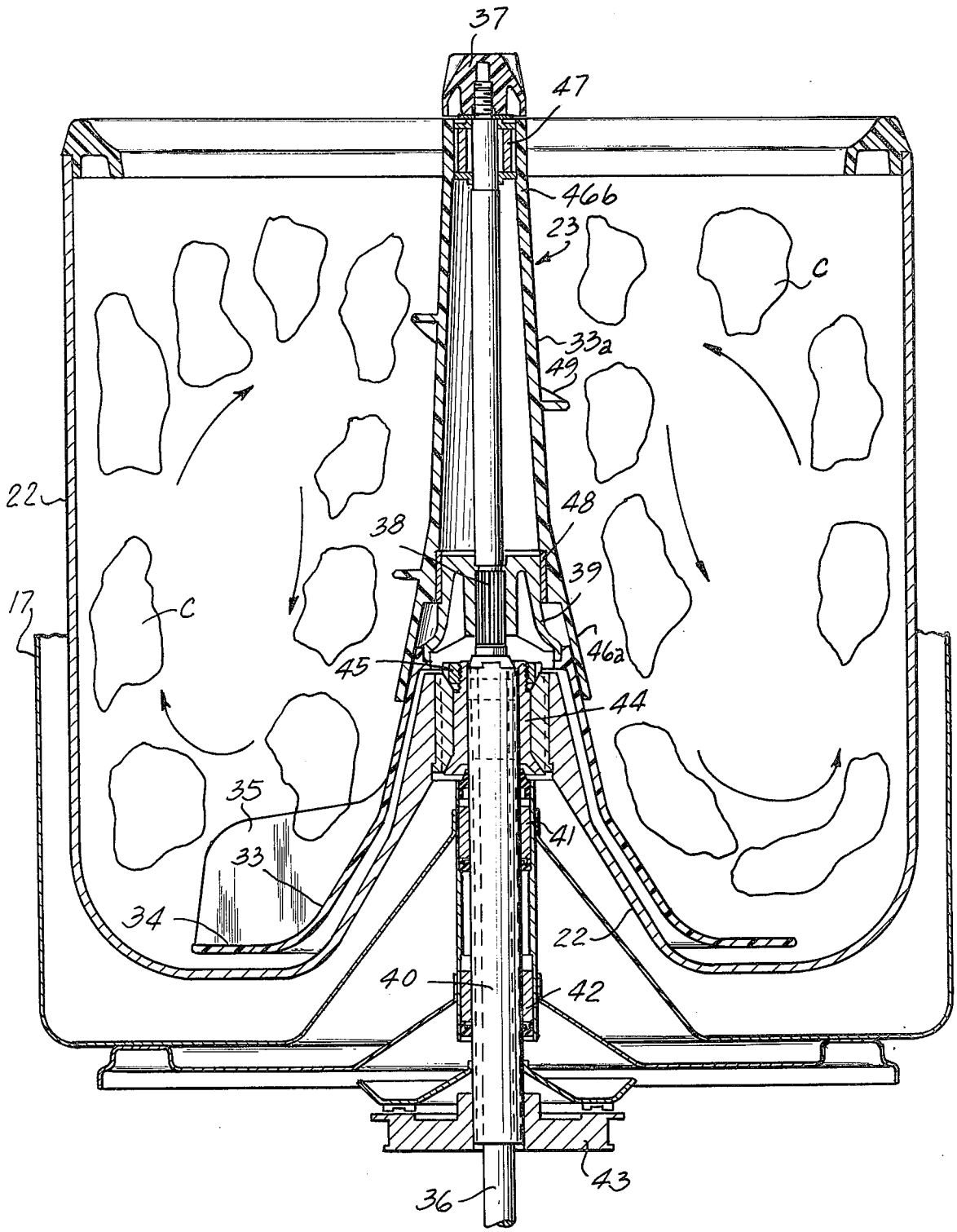
FIG. 2 is a vertical cross-sectional view of the improved agitator means of the present invention during a washing cycle showing the manner in which the clothes are rolled over to insure efficient contact with the wash liquid.

As seen in FIG. 2, the agitator means 23 has a lower agitator element 33 with a skirt portion 34 which carries a plurality of spaced, generally vertical agitator vanes 35. An agitator drive shaft 36 extends through the lower agitator element 33 and an upper agitator element **33*a* and is threadedly received within an agitator cap 37. The shaft 36 has a splined portion 38 which is rigidly connected to an agitator drive coupler 39 for oscillating the lower agitator element 33** in the usual manner.

A spin tube 40 surrounds the shaft 36 over a portion of its length and is received between spaced bearings 41 and 42. A pulley 43 is provided about the spin tube 40 for mechanical connection to a drive motor and transmission in the usual manner. The upper end of the spin tube 40 is received within a basket drive block 44 and its associated nut 45 to drive the basket 22 at high speed during the extraction cycle when wash liquid is removed from the clothes by centrifugal force.

Figure 3:
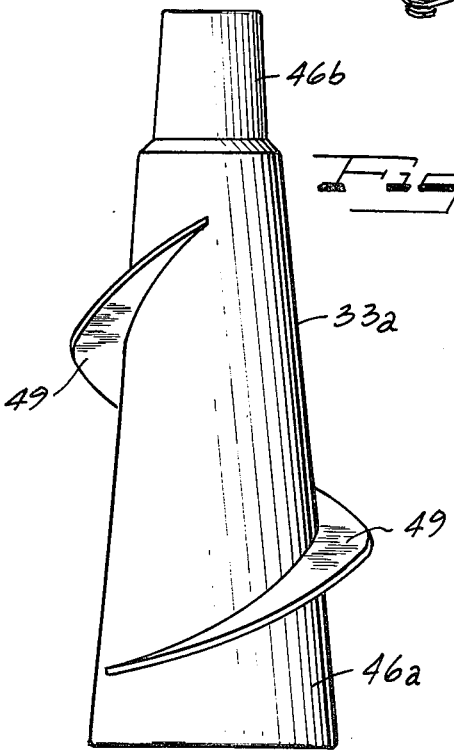
FIG. 3 is a view in elevation of the upper agitator element shown in the assembly of FIG. 2.

The upper agitator element **33*a* is composed of a synthetic resin or the like and, as illustrated in FIGS. 2 and 3 is hollow and has a larger-diameter end portion 46*a* in the area adjacent to the lower agitator element 33, and a smaller-diameter upper portion 46*b* at the upper end thereof. As best illustrated in FIG. 2, the lower end of the upper agitator element 33*a* is received in overlapping relationship with the upper portion of the lower agitator element 33. The agitator drive shaft 36 extends up through the upper agitator element 33*a* and is mechanically coupled thereto through a one-way drive mechanism such as a one-way clutch 47 (which may be for example, a Torrington positive grip one-way roller clutch model RCB-101416) located at the upper end of the shaft 36. A sleeve bearing 48 provides for relative rotation between the lower agitator element 33 and the upper agitator element 33*a*.**

The outer periphery of the upper agitator element **33*a* is provided with vane means 49 for urging clothes downwardly. A continuous helical vane 49 coaxial with the axis of rotation of the lower agitator element 33 is shown extending outwardly from the conical wall of the upper agitator element 33*a* down the length of the upper agitator element 33*a* and terminating short of the vertical agitator vanes 35 for urging or deflecting clothes downwardly. With the arrangement shown, the upper agitator element 33*a* is positively driven through one-way clutch 47 only when the agitator drive shaft 36 is moved in a counterclockwise direction. Under very light loads the upper agitator element will tend to oscillate with the lower agitator element 33. However, under a full clothes load, when the agitator drive shaft 36 moves in a clockwise direction, the one-way clutch 47 allows the upper agitator element to remain relatively stationary due to the frictional drag placed thereon by the water and clothes within the basket. Thus there is substantially automatic sensing of the magnitude of the clothes load to provide incremental rotation under clothes load conditions. This incremental or intermittent rotation of the upper agitator element 33*a* with a clothes load provides a double action and causes the helical vane 49 to act as an auger and thus auger or urge the clothes identified at reference numeral C downwardly along the upper agitator element into the oscillating vertical agitator vanes 35 which move the clothes out radially toward the periphery of the basket 22, thence upwardly and inwardly toward the upper agitator element 33*a*, all as indicated by the arrows shown in FIG. 2 of the drawings. This creates a highly desirable generally toroidal rollover movement or action which subjects the clothes to intimate contact with the washing liquid and to effective scrubbing action from the lower agitator element. (In FIG. 2,** the washing liquid has been omitted, and only a partial clothes load has been illustrated for purposes of clarity).

Figure 4:
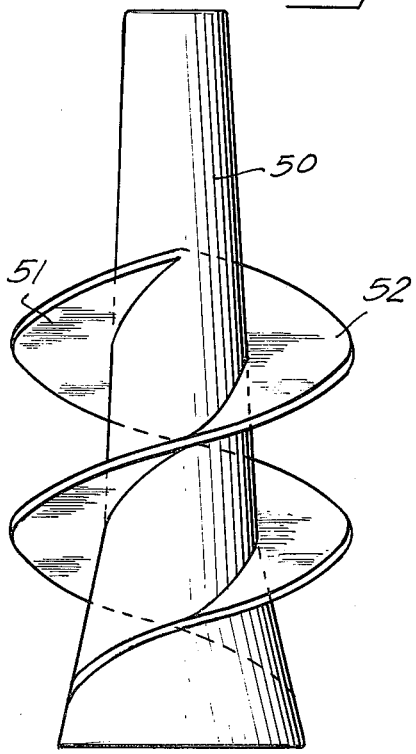
FIG. 4 is an elevational view of a modified form of upper agitator element which can be used for the purposes of the present invention.

A modified form of upper agitator element 50 for use in the present invention is illustrated in FIG. 4 of the drawings. This figure illustrates an upper agitator element 50 having two helical vanes 51 and 52 each having a pitch differing somewhat from the pitch of the helical vane 49 shown in detail in FIG. 3 which advantageously may have 1-¼turns over the length of upper agitator element **33*a*.** The pitch of these helical vanes affects the rate at which clothes are moved down along the upper agitator element with a greater pitch increasing the rate.

From the foregoing, it will be seen that the present invention provides an agitator means having a low agitator element mounted for oscillating motion about an axis and an upper agitator element mounted for unidirectional rotation concurrently about the same axis, the upper agitator element having means associated therewith for urging or forcing clothes adjacent the upper portion down to the lower portion of the agitator means and into the oscillatory path of the lower agitator portion. This type of double action or dual agitator especially improves the washing action of heavy loads of clothes because the unidirectional upper portion urges the clothes down to the oscillating lower portion for positive rollover and washing action. Thus the present invention provides means for effectively washing a relatively large clothes load with a given amount of washing liquid thereby permitting economies in water usage, detergent usage, and power usage for heating the washing liquid. The agitator means provides good washing action for both light and heavy loads, with the oscillating lower portion providing most of the action on the light loads. In addition, the agitator means is simple and easy to construct and can be accommodated on conventional drive shaft constructions. Furthermore, the pitch of vanes associated with the agitator means can be varied to change the downward movement of the clothes during agitation, thereby making the agitator means more readily adaptable to various sizes and shapes of baskets.

It should be evident that various modifications can be made to the described embodiments without departing from the scope of the present invention.

I claim:

1. In an automatic washer having a washing receptacle for containing washing liquid and the items to be washed, agitator means within said receptacle for imparting a rollover motion to said items to be washed, and drive means for driving said agitator means, said agitator means comprising:

a lower agitator element driven by the drive means in an oscillatory manner, an upper agitator element mounted above the lower agitator element and co-axial therewith, said upper agitator element being positively rotationally driven by the drive means in one direction only, and means associated with the upper agitator element for imparting a downward motion to the items to be washed.

2. In an automatic washer as claimed in claim 1 wherein the means associated with the upper agitator element for imparting a downward motion to the items to be washed comprises vane means located on an outer portion of said upper agitator element.

3. In an automatic washer as claimed in claim 2 wherein the vane means comprises a helical vane rigidly affixed to and extending radially outwardly from the perimeter of the upper agitator element such that rotation of said helical vane with said upper agitator element forces the items to be washed in a downward direction along said upper agitator element.

4. In an automatic washer as claimed in claim 1 wherein a lower end of said upper agitator element is received in overlapping relationship with respect to an upper end of said lower agitator element.

5. In an automatic washer as claimed in claim 1 wherein said drive means includes a drive shaft in coaxial and driving relationship with the upper and lower agitator elements.

6. In an automatic washer as claimed in claim 5 wherein the upper portion of the drive shaft engages a one-way clutch, said one-way clutch driving the upper agitator element.

7. An agitator assembly for an automatic clothes washing machine comprising:

a lower agitator element, an upper agitator element positioned above the lower agitator element, drive means for driving the lower agitator element in an oscillatory manner and the upper agitator element in a unidirectional manner, and means associated with the upper agitator element for urging articles adjacent thereto in a downward direction.

8. An agitator assembly for an automatic washing machine as claimed in claim 7 wherein the upper agitator element is in coaxial relationship with the lower agitator element and wherein the lower end of said upper agitator element is received in overlapping relationship with respect to the upper end of said lower agitator element.

9. An agitator assembly for an automatic washing machine as claimed in claim 7 wherein the lower agitator element includes a lower skirt portion having a plurality of generally vertically-disposed vanes extending upwardly and radially outwardly therefrom.

10. An agitator assembly for an automatic washing machine as claimed in claim 7 wherein the means associated with the upper agitator element for urging articles in a downward direction comprises vane means located at the outer perimeter of said upper agitator element.

11. An agitator assembly for an automatic washing machine as claimed in claim 10 wherein the vane means comprises a helical vane rigidly affixed to and extending radially outwardly from the perimeter of the upper agitator element such that rotation of said helical vane with said upper agitator element urges the items to be washed in a downward direction along said upper agitator element.

12. An agitator assembly for an automataic washer as claimed in claim 7 wherein the drive means for driving the lower and upper agitator elements includes a drive shaft in driving relationship with said lower and upper agitator elements, and wherein said drive means also includes a one-way clutch operably coupling said upper agitator element with said drive shaft.

13. In a clothes washing machine having a washing receptacle, means for effecting a rollover movement of the clothes in the receptacle during a washing operation, said means comprising:

a double-action agitation means mounted substantially means including an oscillating lower element provided with vanes to direct clothes outwardly toward the perimeter of said receptacle, and a unidirectional intermittently rotating upper element having vane means for positively urging clothes downwardly to said lower element, said upper and lower elements interacting to produce said rollover movement of said clothes during the washing operation.

14. In a clothes washing machine having a washing receptacle as claimed in claim 13 wherein the vane means associated with the upper element comprises a helical vane rigidly affixed to and extending radially outwardly from the perimeter of the upper agitator element.

15. In a clothes washing machine having a washing receptacle, as claimed in claim 13 wherein the vane means associated with the upper element comprises a plurality of helical vanes rigidly affixed and extending radially outwardly from the perimeter of the upper agitator element.

16. In an automatic washer having a clothes washing receptacle, agitator means within said receptacle, and drive means having a drive shaft engageable with said agitator means, an improvement in said agitator means comprising:

a lower agitator element connected to said drive shaft for oscillating motion therewith, an upper agitator element disposed above the lower agitator element and coaxial therewith, and one-way clutch means interconnecting said upper agitator element with said drive shaft for unidirectional rotation of said upper agitator element.

17. In an automatic washer as claimed in claim 16 wherein vane means in the form of an auger are associated with the upper agitator element for inducing a flow pattern within the clothes washing receptacle downwardly along said lower agitator element.

18. In an automatic washer as claimed in claim 16 wherein the vane means associated with the upper agitator element for inducing a flow pattern within the clothes washing receptacle downwardly along said lower agitator element includes a helical vane rigidly affixed to and extending radially outwardly from the perimeter of the upper agitator element.

19. In an automatic washer having a washing receptacle for containing washing liquid and the items to be washed and an oscillating vertical drive shaft extending into the lower central portion of said receptacle, improved agitator means comprising:

a lower agitator element within the receptacle and having a hollow center portion for receiving the drive shaft, said lower element coaxial with and coupled to said drive shaft for oscillatory motion therewith and having a lower skirt portion with vertical vanes;

an upper agitator element above and coaxial with the lower element, the upper end of said lower element being received in overlapping relationship by the lower end of said upper element, said upper element having a helical vane affixed about its outer portion for urging the items to be washed adjacent said helical vane downwardly towards said lower element, and a one-way clutch operably connecting the upper agitator element to the drive shaft for unidirectional rotation of said upper agitation element, whereby a rollover pattern of movement for the items to be washed is achieved within the receptacle with said items being urged downwardly along said upper agitator element by said helical vane and radially outwardly, and then upwardly by said lower agitator element.

20. An agitator assembly for oscillation about a vertical axis in washing fluid within a fabric receiving receptacle of a clothes washing machine comprising:

a first vaned lower member oscillatable about said vertical axis for effecting the scrubbing of fabrics placed within said receptacle, a second member mounted above said first vaned lower member and movable relative thereto, drive means connected to said first vaned lower member for imparting an oscillatory movement thereto, and means interconnecting said drive means with said second member for imparting an intermittent rotary movement in one direction only to said second member during the oscillation of said first vaned lower member to thereby effect a toroidal rollover movement of said fabrics about said vertical axis.

21. An agitator assembly for oscillation about a vertical axis in washing fluid within a fabric receiving receptacle of a clothes washing machine comprising:

a first vaned lower member oscillatable about said vertical axis for effecting the scrubbing of fabrics placed within said receptacle, a second member mounted above said first lower vaned member and movable relative thereto, drive means connected to said first vaned lower member for imparting an oscillatory movement thereto, and means including one-way clutch means interconnecting said drive means with said second member to effect an intermittent rotary movement of said second member during the oscillation of said first vaned lower member and engagement of both of said first and second members with said fabrics to thereby effect a toroidal rollover movement of said fabrics about said vertical axis.

22. An agitator assembly for oscillation about a vertical axis in a washing fluid within a fabric receiving receptacle of a clothes washing machine comprising:

a vaned lower member oscillatable about a vertical axis for effecting the scrubbing of fabrics placed within said receptacle, drive means connected to said vaned lower member for imparting an oscillatory movement to said vaned lower member, a vaned upper member coaxially mounted above said vaned lower member and movable relative thereto, and means drivingly connecting said vaned upper member to said drive means so as to impart an intermittent rotary movement in one direction only to said vaned upper member about said vertical axis upon oscillation of said drive means and engagement of said vaned upper member with said fabrics, said vaned upper member deflecting said fabrics downwardly about said vertical axis during the oscillation of said drive means so as to impart a generally toroidal movement to said fabrics about said vertical axis.

23. An agitator assembly for oscillation about a vertical axis in a washing fluid within a fabric receiving receptacle of a clothes washing machine comprising:

a vaned lower member oscillatable about a vertical axis for effecting the scrubbing of fabrics placed within said receptacle, drive means connected to said vaned lower member for imparting an oscillatory movement to said vaned lower member, an upper member coaxially mounted above said vaned lower member and movable relative thereto, means including a one-way clutch means interconnecting said drive means with said upper member to effect an intermittent rotary movement of said upper member about said vertical axis upon oscillation of said drive means and engagement of said upper member with said fabrics, said upper member including at least one helical vane for deflecting said fabrics downwardly about said vertical axis during the oscillation of said drive means so as to impart a generally toroidal movement to said fabrics about said vertical axis.

24. An agitator assembly for oscillation about a vertical axis in a washing fluid within a fabric receiving receptacle of a clothes washing machine comprising:

a vaned lower member oscillatable about said vertical axis for effecting the scrubbing of fabrics placed within said receptacle, drive means connected to said vaned lower member for imparting an oscillatory movement to said vaned lower member, and fabric engaging means mounted above said vaned lower member for movement relative thereto in one direction only and drivingly connected to said drive means for imparting a toroidal movement to said fabrics during the oscillation of said vaned lower member.

25. An agitator assembly for a clothes washing machine comprising:

a first agitator element, a second agitator element, drive means for driving said first agitator element in an oscillatory motion and for concurrently driving said second agitator element in a unidirectional rotary motion, said first and second agitator elements cooperating to circulate the contents of the machine in a toroidal rollover pattern within the washing machine, and means associated with said second agitator element for forcing articles adjacent thereto into the oscillatory path of said first agitator element and into said rollover pattern.

26. In a clothes washing machine having a washing receptacle, means for effecting a rollover movement of the clothes in the receptacle during a washing operation, said means comprising:

a double-action agitation means mounted substantially centrally of said washing receptacle, said agitation means including an oscillating first element provided with vanes from direct clothes outwardly toward the perimeter of said receptacle as a portion of a rollover pattern, and a unidirectional intermittently rotating second element having vane means for positively urging clothes into a rollover pattern, said first and second elements interacting to insure positive rollover movement of said clothes during the washing operation.

27. An agitator assembly for oscillation about a vertical axis in washing fluid within a fabric receiving receptacle of a clothes washing machine comprising:

a first vaned member oscillatable about said vertical axis for effecting the scrubbing of fabrics placed within said receptacle, a second member movable relative thereto, drive means connected to said first vaned member for imparting an oscillatory movement thereto, and means interconnecting said drive means with said second member for imparting an intermittent rotary movement substantially in one direction to said second member during the oscillation of said first vaned member to thereby effect a toroidal rollover movement of said fabrics about said vertical axis.

28. In a washer having a clothes washing receptacle, agitator means within said receptacle, and drive means having a drive shaft engageable with said agitator means, an improvement in said agitator means comprising:

a first agitator element in said receptacle connected to said drive shaft for oscillating motion therewith, a second agitator element in said receptacle, said second agitator element having clothes contacting means projecting therefrom, and coupling means interconnecting said first agitator element with said second agitator element for substantially unidirectional rotation of said second agitator element in said clothes washing receptacle concurrently with oscillation of said first agitator element to facilitate rollover of clothes during a clothes washing operation in said receptacle.

29. In a washer as claimed in claim 28 wherein said first agitator element includes vane means for scrubbing clothes.

30. In a washer as claimed in claim 28 wherein said clothes contacting means projecting from said second agitator element comprises a helical projection coaxial with the axis of rotation of said second agitator element.

31. An agitator assembly for use within a vertical axis washing machine adapted to receive washing fluid and fabrics to be washed within said washing fluid, said agitator assembly comprising:

a first agitator member including means for receiving an oscillatory input drive member from said machine for imparting an oscillatory motion to said first agitator member, a second agitator member mounted adjacent said first agitator member and movable relative thereto including means for driving said second agitator member in an intermittent, substantially unidirectional motion upon oscillation of said first agitator member, and fabric deflecting means on said second agitator member movable in response to said unidirectional motion for urging fabrics positioned adjacent said second agitator member within said washing fluid in a generally toroidal fluid circulatory path for repetitive contact with said first agitator member to effect a scrubbing of said fabrics by said first agitator member.

32. An agitator assembly for use within a vertical axis washing machine adapted to receive washing fluid and fabrics to be washed within said washing fluid, said agitator assembly comprising:

a first agitator member including means for receiving an oscillatory input drive member from said machine for imparting an oscillatory motion to said first agitator member, and a second agitator member having fabric deflecting means thereon mounted adjacent said first agitator member and movable thereto for urging fabrics positioned adjacent said fabric deflecting means within said washing fluid toward said first agitator member in a generally toroidal fluid circulatory path to effect a scrubbing of said fabrics by said first agitator member, said second agitator member having drive means connected thereto for moving said second agitator member as a separate unidirectional rotational movement relative to said first agitator member.

* * * * *

UNITED STATES PATENT AND TRADEMARK OFFICE

CERTIFICATE OF CORRECTION

PATENT NO. : 3,987,651

DATED : October 26, 1976

INVENTOR(S) : Clark I. Platt

It is certified that error appears in the above-identified patent and that said Letters Patent are hereby corrected as shown below:

Claim 13, column 6, lines 39 and 40, after "substantially" insert --centrally of said washing receptacle said agitation--.

Claim 26, column 9, line 31, cancel "from" and substitute therefor --to--.

Signed and Sealed this second Day of August 1977

[SEAL]

*Attest:*

RUTH C. MASON
*Attesting Officer*

C. MARSHALL DANN
*Commissioner of Patents and Trademarks*